US007024841B2

(12) United States Patent
Krämer et al.

(10) Patent No.: US 7,024,841 B2
(45) Date of Patent: Apr. 11, 2006

(54) DEVICE FOR SLEEVE-LABEL LABELING MACHINES

(75) Inventors: Klaus Krämer, Dortmund (DE); Lutz Deckert, Gelsenkirchen (DE)

(73) Assignee: KHS Maschinen-und Anlagenbau Aktiengesellschaft, Dortmund (DE)

( * ) Notice: Subject to any disclaimer, the term of this patent is extended or adjusted under 35 U.S.C. 154(b) by 0 days.

(21) Appl. No.: 10/653,617

(22) Filed: Sep. 2, 2003

(65) Prior Publication Data

US 2004/0128958 A1 Jul. 8, 2004

(30) Foreign Application Priority Data

Sep. 3, 2002 (DE) ..... 102 40 520

(51) Int. Cl.
*B65B 11/00* (2006.01)

(52) U.S. Cl. ..... 53/585; 53/291; 53/297; 53/298; 83/180

(58) Field of Classification Search ..... 53/291, 53/295, 296, 298, 567, 585; 156/86, 521; 83/54, 180; 493/288
See application file for complete search history.

(56) References Cited

U.S. PATENT DOCUMENTS

| | | | | | |
|---|---|---|---|---|---|
| 1,758,729 | A | * | 5/1930 | Wilson | 83/56 |
| 2,846,835 | A | * | 8/1958 | Rice et al. | 53/291 |
| 2,852,899 | A | * | 9/1958 | Murrell | 53/585 |
| 2,860,468 | A | * | 11/1958 | Aguilar et al. | 53/291 |
| 3,252,388 | A | * | 5/1966 | Schur | 493/288 |
| 3,910,013 | A | * | 10/1975 | Babineau | 53/291 |
| 4,889,023 | A | * | 12/1989 | Languillat | 83/54 |
| 6,474,390 | B1 | * | 11/2002 | Vandevoorde | 53/585 |
| 6,684,599 | B1 | * | 2/2004 | Fresnel | 53/585 |

* cited by examiner

*Primary Examiner*—John Sipos
(74) *Attorney, Agent, or Firm*—Nils H. Ljungman & Associates

(57) ABSTRACT

Device for sleeve-label labeling machines, with proposal that means are provided that render the label tube taut and/or spread the label tube during the cutting step.

18 Claims, 13 Drawing Sheets

DEVICE FOR SLEEVE-LABEL LABELING MACHINES

The invention relates to a device for an expanding apparatus for label tubes, particularly in sleeve-label labeling machines.

Many solutions pertaining to the affixing of labels to containers, such as, for example, bottles or cans, have become known in the art.

Aside from labeling machines that process sheet-type paper labels, also so-called roll-feed machines have become part of the state of the art. For reasons of economics, these machines do not process sheet-type labels, but use is made of thinner plastic labels which are wound in large number as continuous strip onto a roller. For labeling, individual labels are cut from this roller and are subsequently wound about the container and are there secured, for example, by gluing.

A further group of labeling machines are the so-called sleeve machines.

In this type of machine, plastic labels are also used which are wound in large number as continuous strip onto a roller. However, the plastic strip is configured as a tube, such that the labels, upon being cut, comprise a tube section which is placed in its entirety about the container. The adhesion of this tube section to a container can essentially be accomplished in two ways. Firstly, the option is provided to shrink the tube section upon placing it about the container by supply of energy, for example, by provision of heated air, so as to secure the tube section to the container. Also, there is the option to utilize a label tube section that has such an inner diameter that it needs to be somewhat expanded, in the elastic range, in order to be placed about a container.

Upon placing of the tube section about a container having been effectuated, the expansion is relaxed and the tube section adheres to the container.

Such labeling machines are used, inter alia, in the beverage industry, for the packaging of foodstuffs, or for packaging of pharmaceutical products.

Since sleeve-label labeling machines are known for quite some time, an exhaustive description of such labeling machines need not be made herein. Accordingly, the following describes in detail only the components and processing steps that are relevant to the present invention.

An essential component of sleeve-label labeling machines is the so-called arbor or mandrel.

The mandrel serves to bring about the round shape of the label tube, the original shape being flat, and to guide the label tube through the labeling machine. For this, the mandrel is introduced into the label tube and is subsequently secured in the labeling machine.

The mandrel is essentially round and its upper end is configured with a more or less prominent tip. In the installed condition, the mandrel extends essentially vertically from above to below. When considered in the longitudinal direction of the mandrel, rollers are provided at one mounting position, or several mounting positions, at the circumference of the mandrel. Such rollers respectively comprise two roller, to configure a pair of rollers, with the axes of the rollers being disposed transversely with respect to the longitudinal direction of the mandrel. Two, three, or four roller pairs are evenly distributed at the circumference of the mandrel depending on the assembly position.

For arresting the mandrel and for driving or, respectively, advancing of the label tube, the labeling machine comprises rollers that can be driven for rotation and that can be brought into working contact with the above described roller pairs of the mandrel, such that the mandrel is positively held within the labeling machine.

Although the mandrel is positively retained, due to the interaction between the rollers of the labeling machine and the pairs of rollers of the mandrel, it is possible to move the label tube in the direction along and downwardly with respect to the mandrel due to the rotation of the rollers of the labeling machine. During such movement, the label tube is located between the rollers of the labeling machine and the roller pairs of the mandrel and slides, by being driven by the rollers of the labeling machine, along the fixedly disposed mandrel in downwardly direction.

Within the region of the lower third of the length of the mandrel a groove is disposed about the entire circumference. This groove configures the clear cutting space for a cutting apparatus that is disposed exteriorly with respect to the label tube. In the case of known arrangements, such cutting apparatus comprise, for example, a swingable knife that is secured to a holder that can be driven with variable numbers of rotation. The knife describes a circular path that is concentric with reference to the longitudinal axis of the mandrel and the knife swings, at an elevated number of rotations of the holder, due to centrifugal force, into an inner position which effectuates severing of a label tube section from the supply.

The severed label tube section is transported by way of further combinations of rollers that can be driven for rotation and roller pairs in the direction along and downwardly with respect to the mandrel.

At the lower end of the mandrel, the label tube is generally gripped by a gripper device and is placed about the container. The process can subsequently be repeated anew.

So as to further increase the operating rate of such labeling machines, it is desirable to further increase the cutting speed that effectuates severing of the label tube and to raise the quality of the cut that is being effectuated.

In known configurations of sleeve-label labeling machines the intended increase of the cutting speed is only possible within narrow limits, because upon increase of cutting velocities, the label tube tends to negatively accumulate, bunch up, ahead of the knife and thus the label tube causes a cut that is not accurate and causes edges that are not precise at the label tube.

Solutions of such problems have hitherto not become known in the state of the art.

The purpose of the object of present invention proceeds from the problems described in the foregoing, namely, to provide respective remedies and improvements, such that during severing of the label tube the attendant processing is carried out with constant quality of the cut and elevated cutting speeds, which together afford shorter cycle times.

For this, the invention teaches that means are provided that expand or, respectively, hold the label tube taut during the severing process, such that the label tube is not detrimentally accumulated ahead of the knife and cutting can be accomplished with high speed and constant quality.

The invention is further described on the basis of embodiments. In detail,

Figure 1:
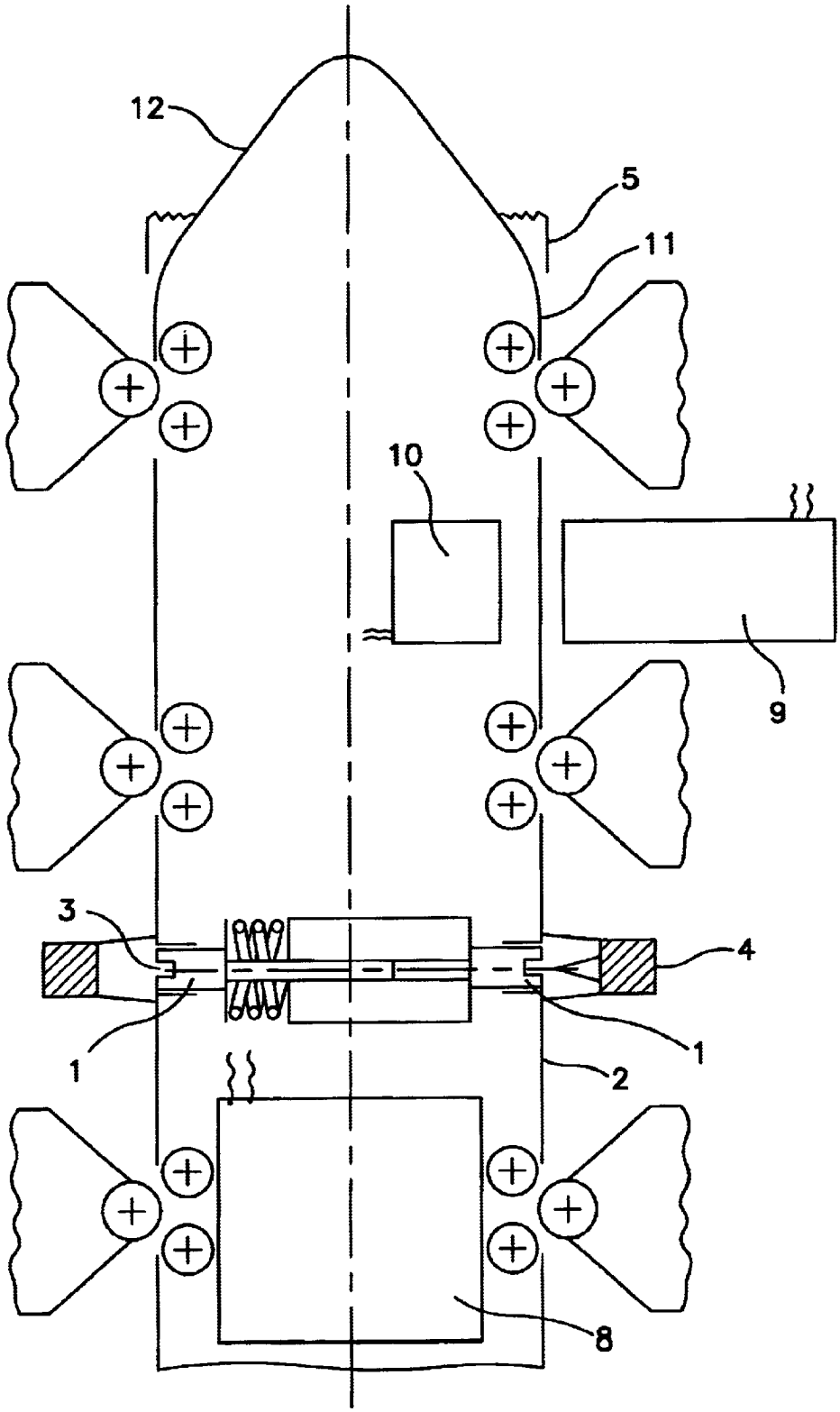
FIG. 1 shows in a simplified cross-sectional illustration a mandrel that is equipped with the components in accordance with the invention.

The invention essentially teaches the performance of the object by the use of one, or several, movable pressure body 1, or movable pressure bodies 1, adapted to the inner diameter of the label tube, with such bodies being disposed or, respectively, journalled within the mandrel 2.

These pressure bodies 1 can be any structures that are configured in any desired configuration; however, they have to be capable, with respect to their outer configuration and their attachment within the mandrel 2, to expand or, respectively render taut, the label tube 5 from the interior thereof.

For example, pressure bodies 1 have been found to be particularly advantageous that have the configuration corresponding to the configuration of a segment of a circle.

The pressure bodies 1 have a groove 3 at their outer surface, which groove 3 configures the clear cutting space for the knife of the cutting apparatus 4.

The respective securement means for these pressure bodies 1 are configured in such a way that they permit movement of the pressure bodies 1 in outwardly direction and in the direction towards the label tube 5, whereupon this label tube 5 is expanded and held taut, this achieving a clean cut at an elevated cutting velocity.

Particular demands are made for the configuration of the design of actuating means for the pressure bodies 1, because the circumferential surfaces 11 and the tip 12 of the mandrel 2 are constantly and fully covered by the label tube 5 during the entire course of the labeling process, and because the label tube 5 must not be damaged.

The actuating means for the pressure bodies 1 may be configured in numerous configurations, that are presented only as embodiment examples in some detail.

Figure 2:
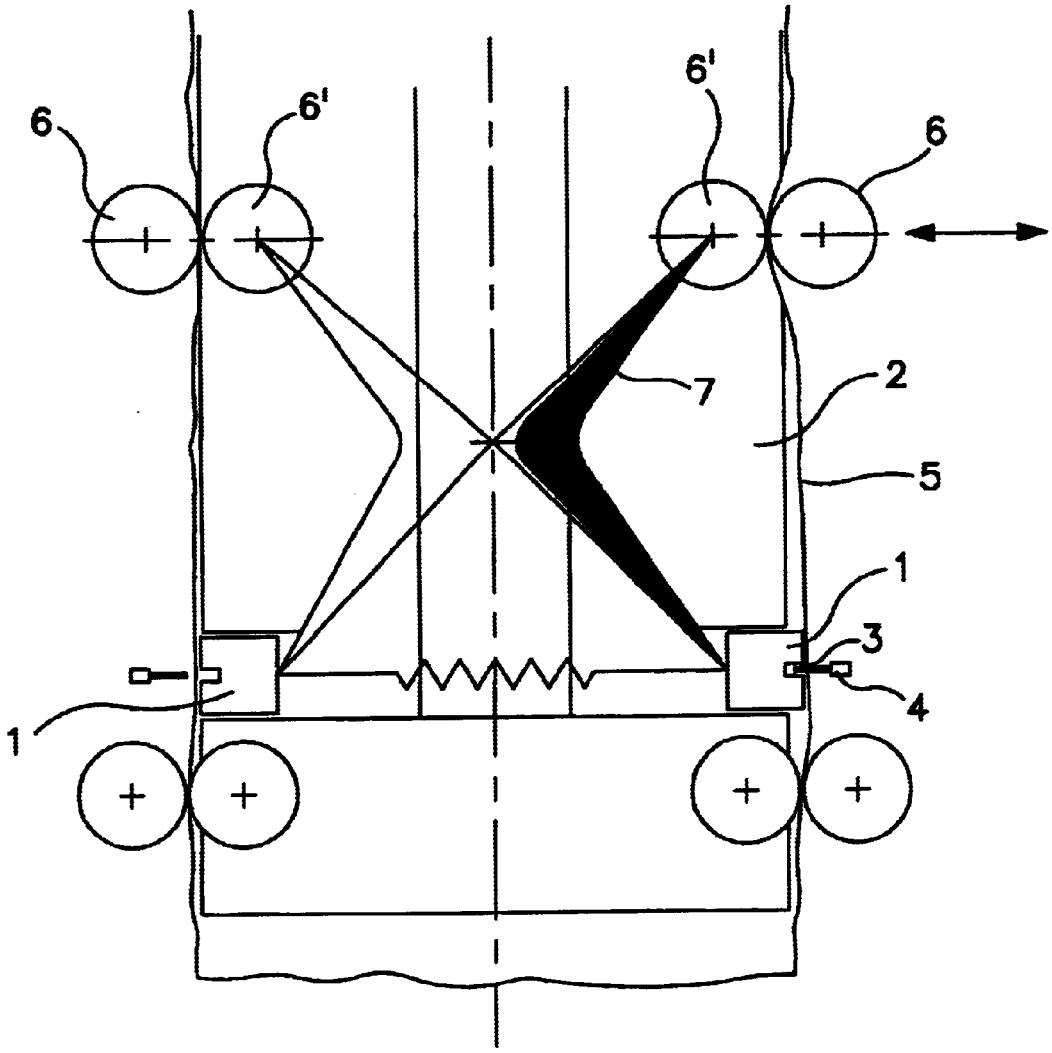
FIG. 2 shows in a simplified cross-sectional illustration a mandrel with control rollers and a lever-actuated expanding apparatus.
Figure 2A:
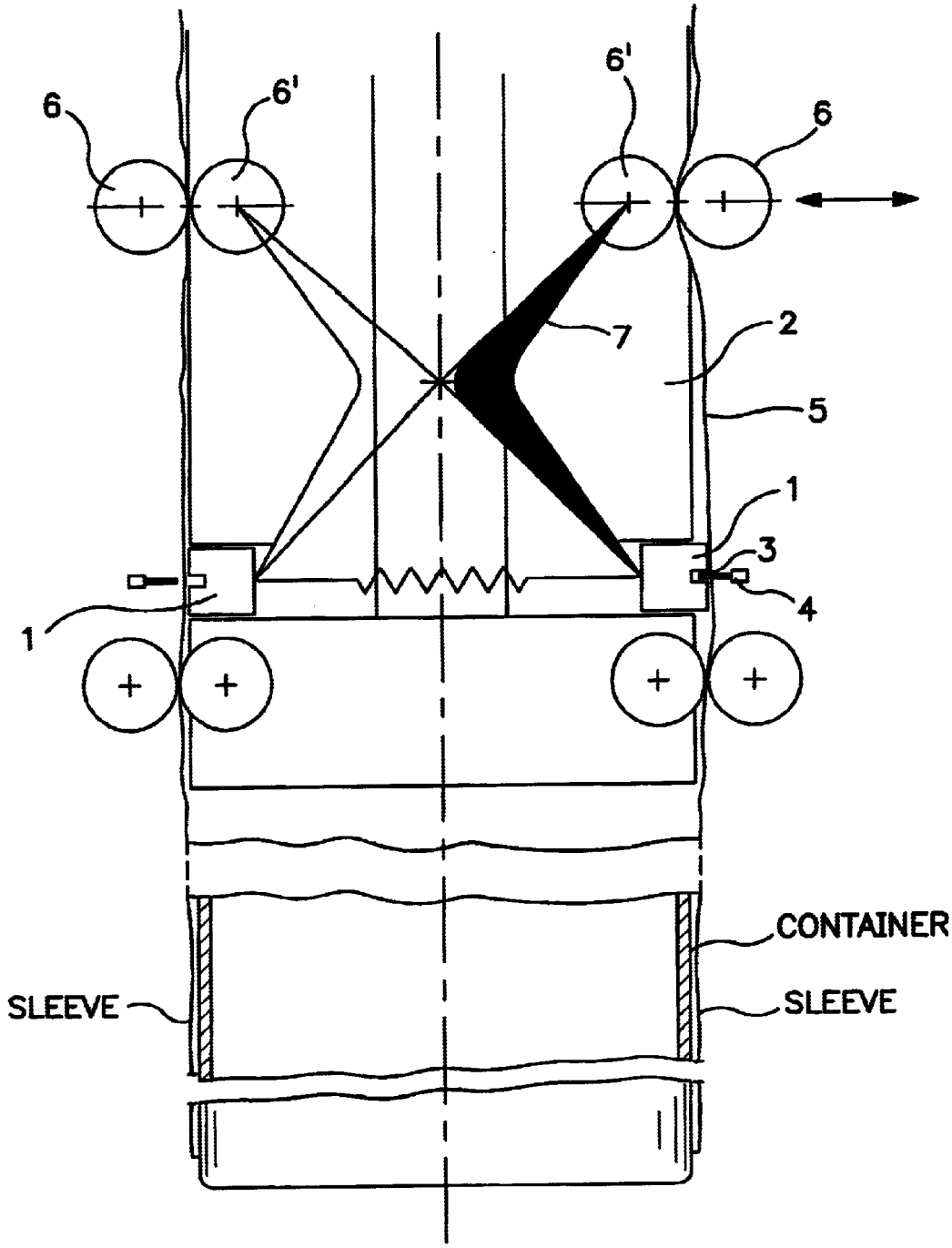
FIG. 2A shows a view similar to FIG. 2 and showing a container over which is passed a sleeve that carries a label.
Figure 2B:
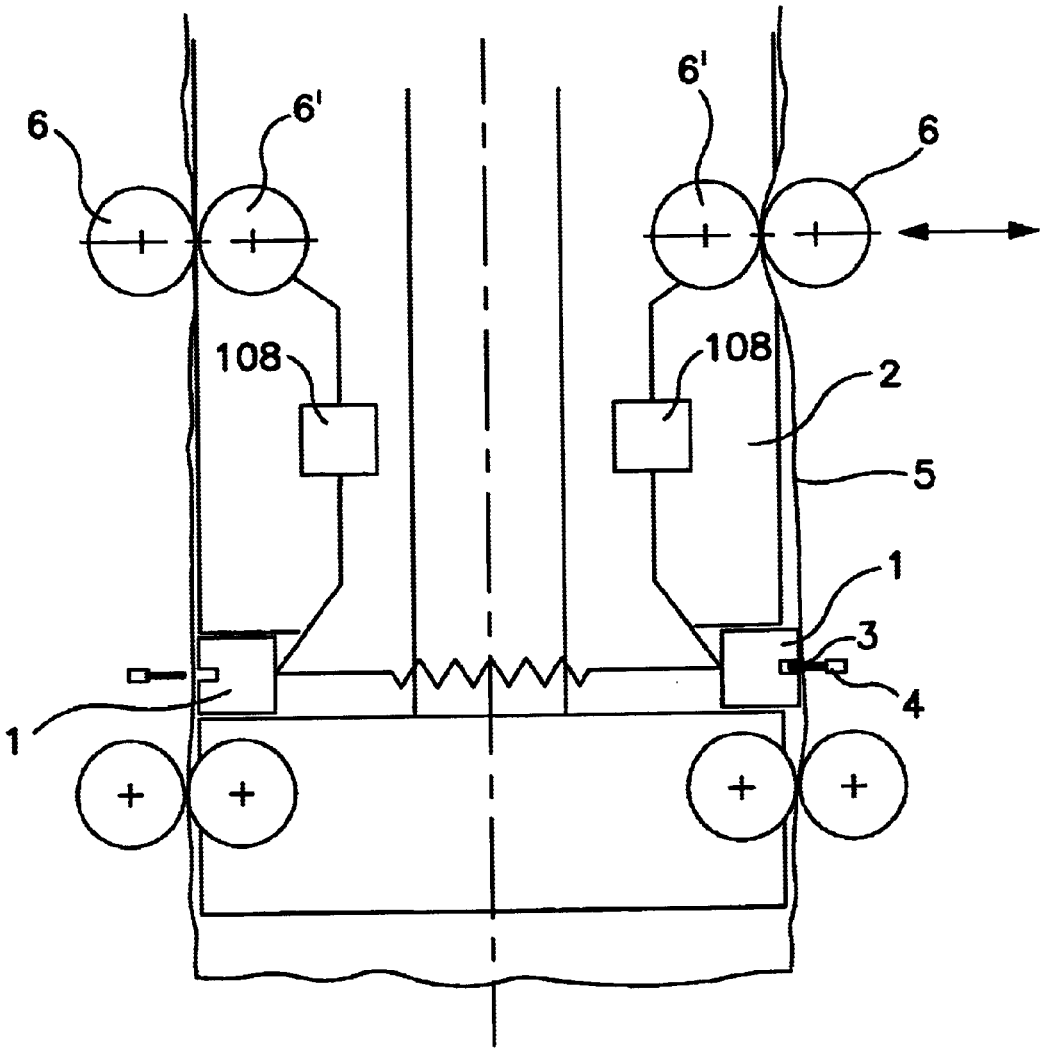
FIG. 2B shows a view of the labeling arrangement according to one possible embodiment including pneumatic components.
Figure 2C:
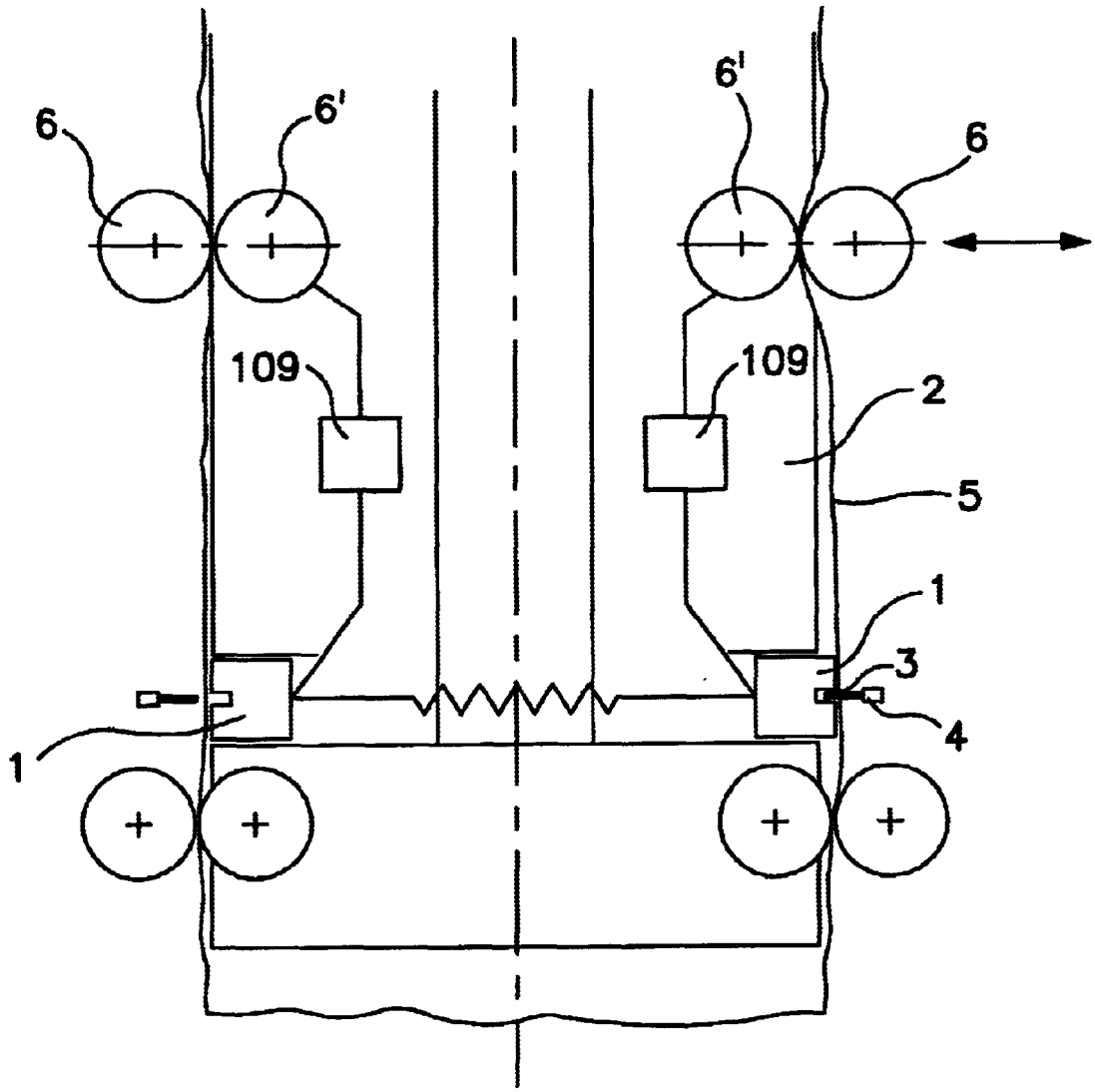
FIG. 2C shows a view of the labeling arrangement according to one possible embodiment including hydraulic components.

It is within the scope of the invention, firstly, that the pressure bodies 1 are actuated from the exterior of the label tube 5 by mechanical means. For example, for actuation, control rollers 6 can be provided at the labeling machine, which control rollers 6 are moved radially towards the mandrel 2 during operation of the expanding apparatus. Within the mandrel 2, means are provided that translate the delivery movement that is effectuated by the control rollers 6 into the expanding movement of the pressure bodies 1. These translating means can be, for example, levers 7 and a counter roller 6'. In a further sensible embodiment of the invention, the delivery movement of the control rollers 6 can be conveyed to the pressure bodies 1 by pneumatic components 108 (see FIG. 2B) or hydraulic components 109 (see FIG. 2C).

Figure 1A:
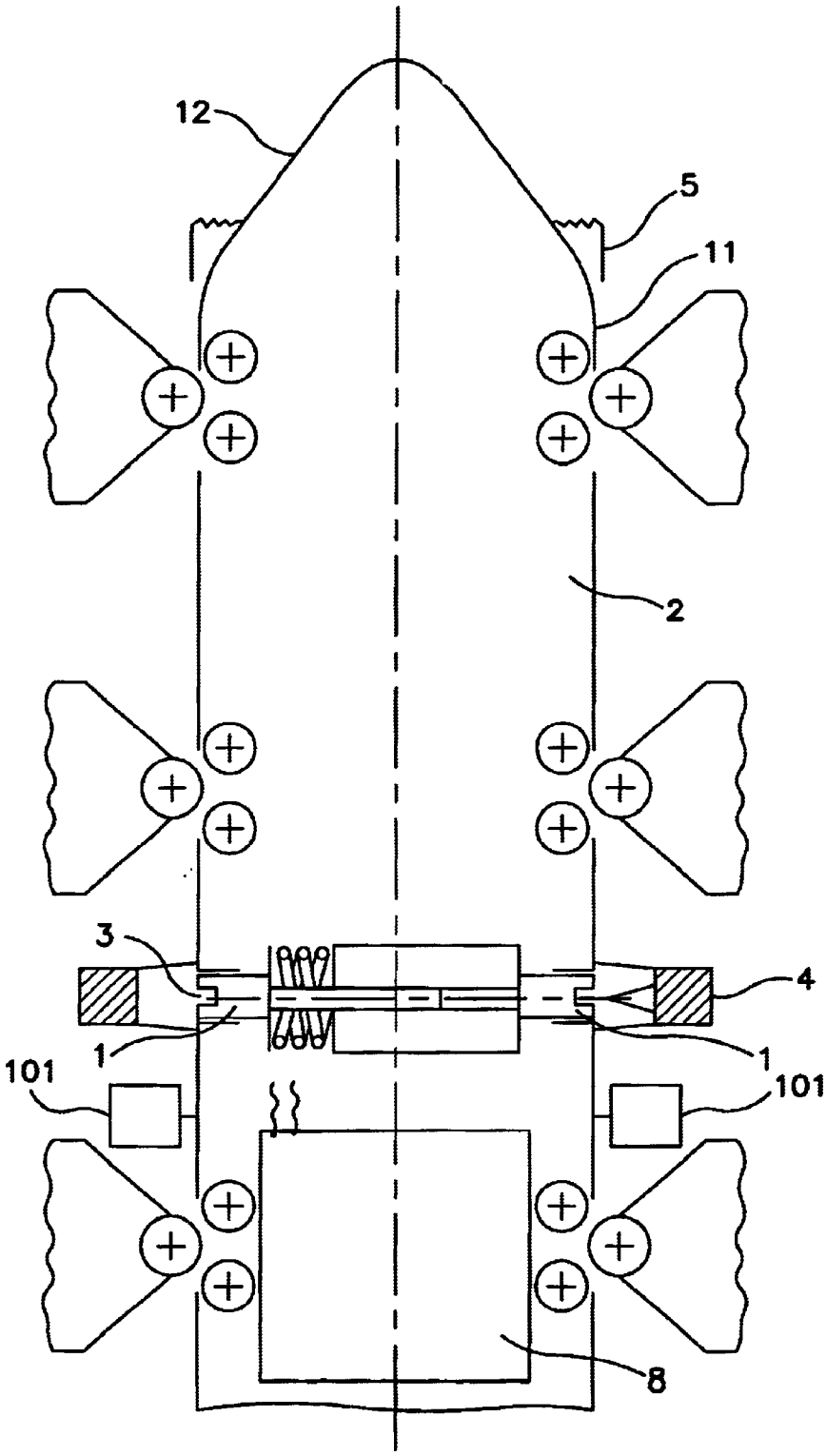
FIG. 1A shows a view of the labeling arrangement according to one possible embodiment including electromagnets.

Furthermore, it is within the scope of the invention to actuate the pressure bodies 1 from the exterior of the label tube 5 by electromagnetic means 101 (see FIG. 1A) For such actuation at least one electromagnet 101 is disposed at the labeling machine in such a way that in its activated state it can interact with the mandrel 2. In this actuating method, the pressure bodies 1 within the mandrel 2 are fully, or partially, made of a magnetic material. When the at least one electromagnet 101 is actuated by way of a machine controller, not illustrated, the pressure bodies 1 move in outwardly direction and expand the label tube 5.

Such an electromagnet 101 can also be disposed within the cutting apparatus 4 or it can be connected in controlling and operative manner to the cutting apparatus 4 in such a way that upon the cutting apparatus being moved into the entry position, simultaneously expansion of or, respectively, activation of the pressure bodies 1 is effectuated.

In further embodiments of the invention that are particularly advantageous, means are disposed within the mandrel 2 that perform the expanding movement of the pressure bodies 1 without input of energy from the exterior of the label tube 5.

Such embodiments present the initial demand to make provision for the energy that is necessary for actuation of the pressure bodies 1 to be available within the mandrel 2. For this, it is firstly within the scope of the present invention to provide at least one accumulator 8, or several accumulators 8, for electrical energy within the mandrel 2. With such an arrangement it is of particular advantage that the at least one accumulator 8 be disposed at the lower end of the mandrel 2. This permits that the accumulator 8 can be exchanged without dismantling of the mandrel 2 or, respectively, without removal of the label tube 5 from the mandrel 2 or, respectively, the removal of the mandrel 2 from the labeling machine.

A further approach of the delivery of energy to the mandrel 2 resides therein that electrical energy is transferred into the mandrel 2 by way of induction. In this method, a transmitter 9 of induction energy is disposed at the labeling machine. The interior of the mandrel 2 houses a receiver 10 for induction energy and the receiver 10 captures the electromagnetic pulses that are emitted by the transmitter 9 of induction energy, and converts the sent electromagnetic impulses again into electrical energy.

Also, when employing energy transmission into the mandrel 2 by way of induction, additional accumulators 8 can be provided within the mandrel 2.

Figure 1B:
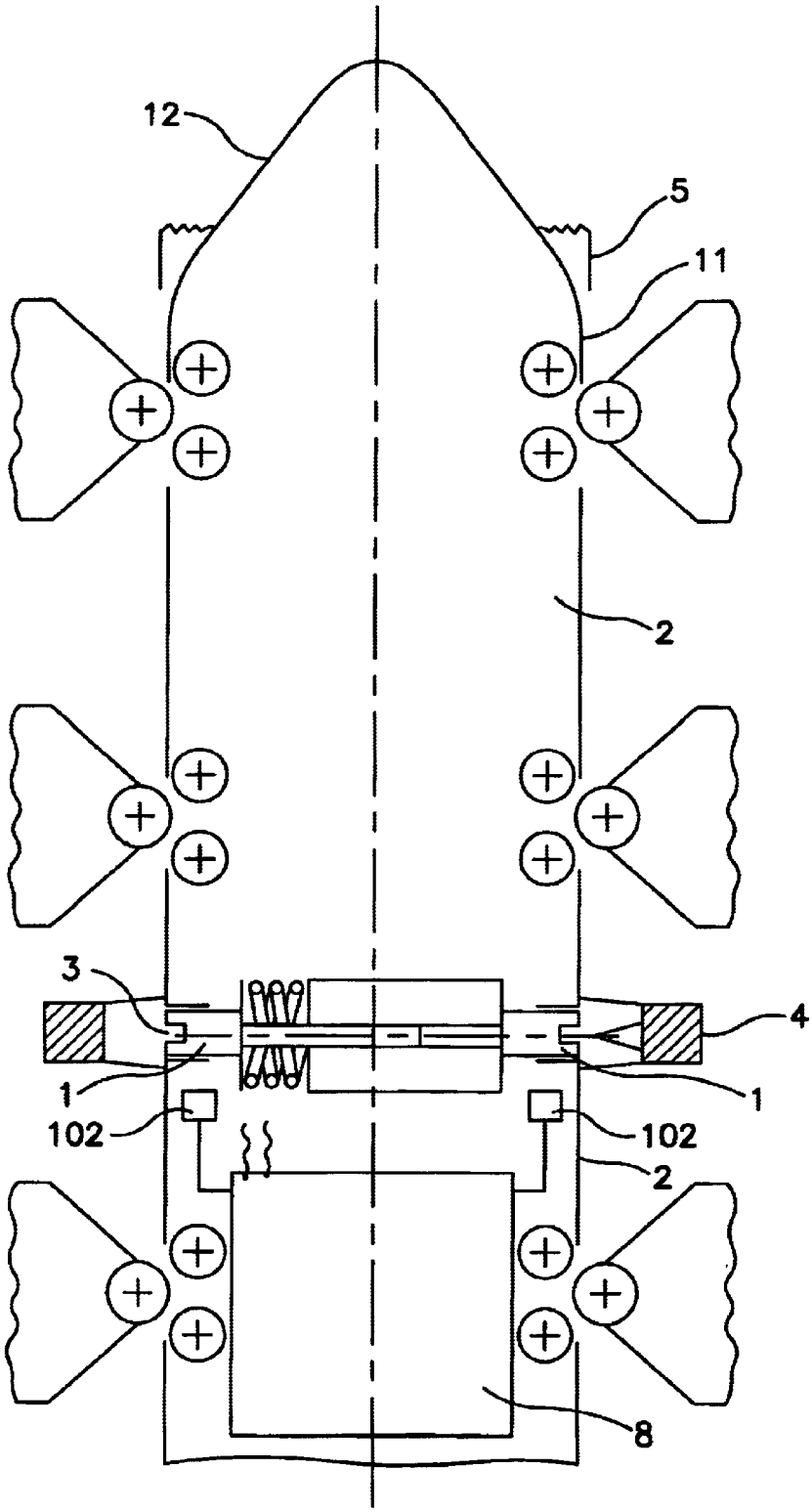
FIG. 1B shows a view of the labeling arrangement according to one possible embodiment including electromagnets in the mandrel.
Figure 1C:
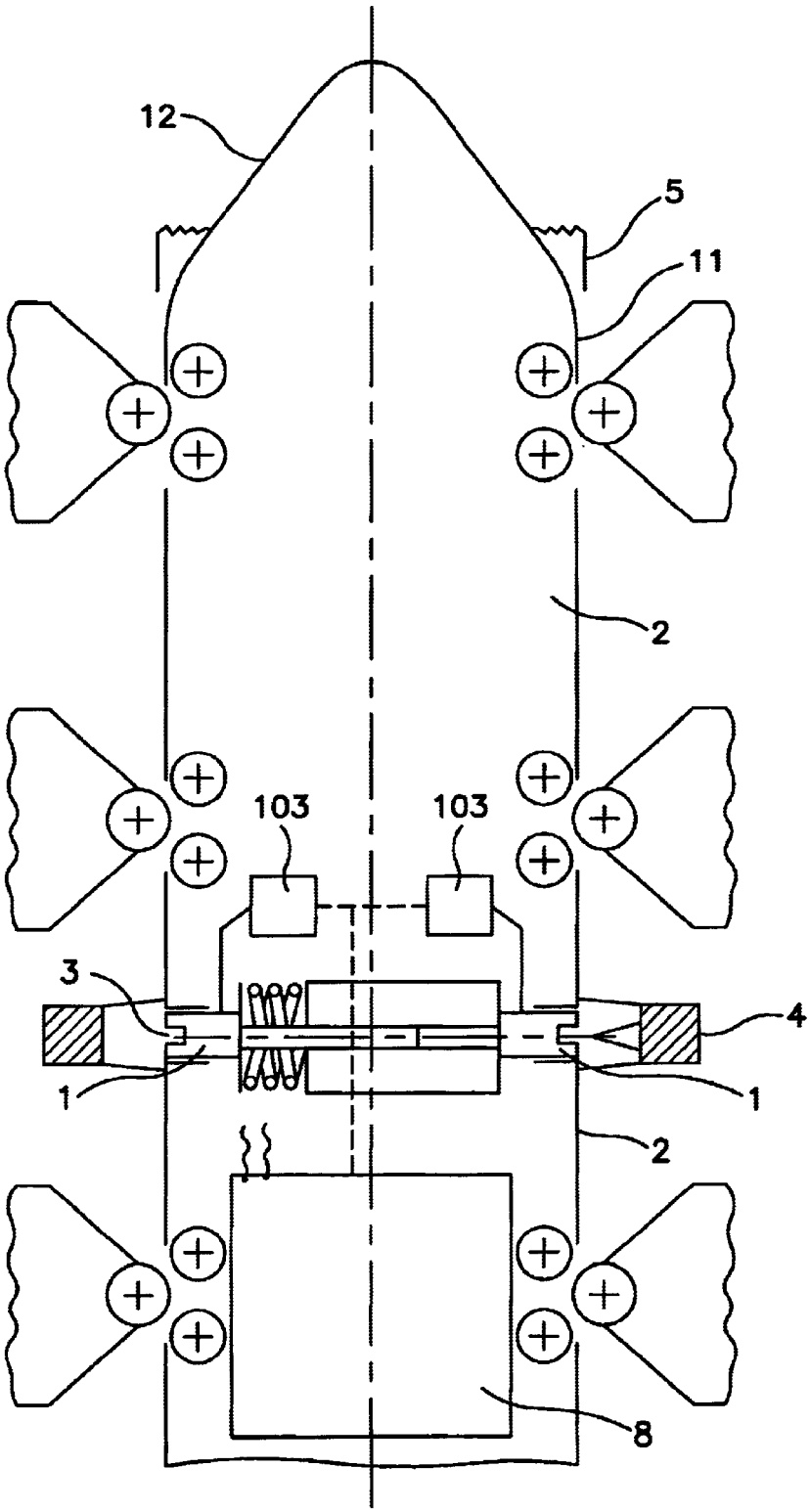
FIG. 1C shows a view of the labeling arrangement according to one possible embodiment including electric motors.

Upon electrical energy being available within the mandrel 2, the actuation of the pressure bodies 1 may be performed in a number of ways. For example, electromagnets 102 (see FIG. 1B, or electric motors 103 (see FIG. 1C), and/or electrical control devices 105 (see FIG. 1E) can be provided that are configured to move the pressure bodies 1.

Figure 1D:
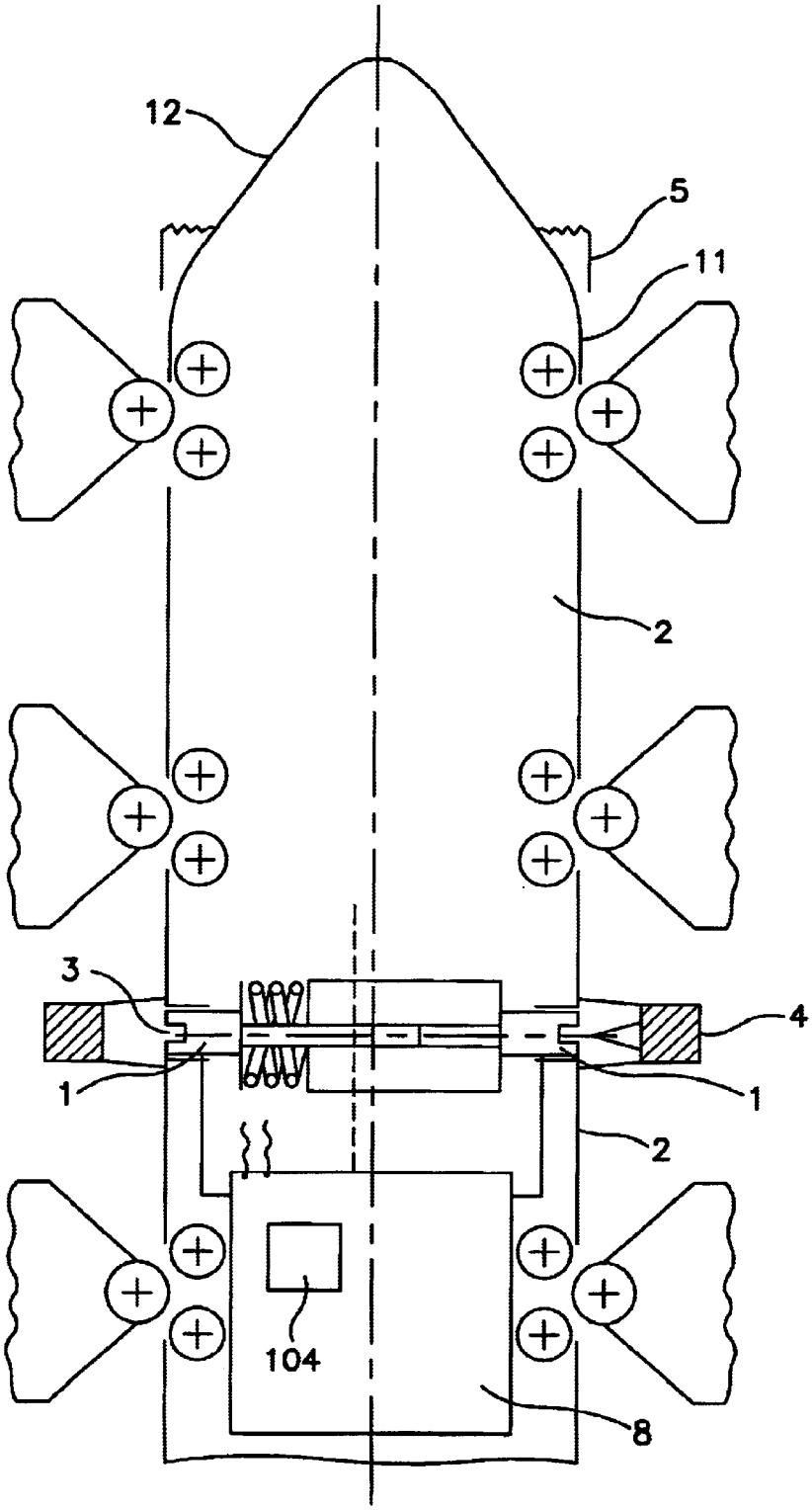
FIG. 1D shows a view of the labeling arrangement according to one possible embodiment including an apparatus to produce an electrostatic charge.
Figure 1E:
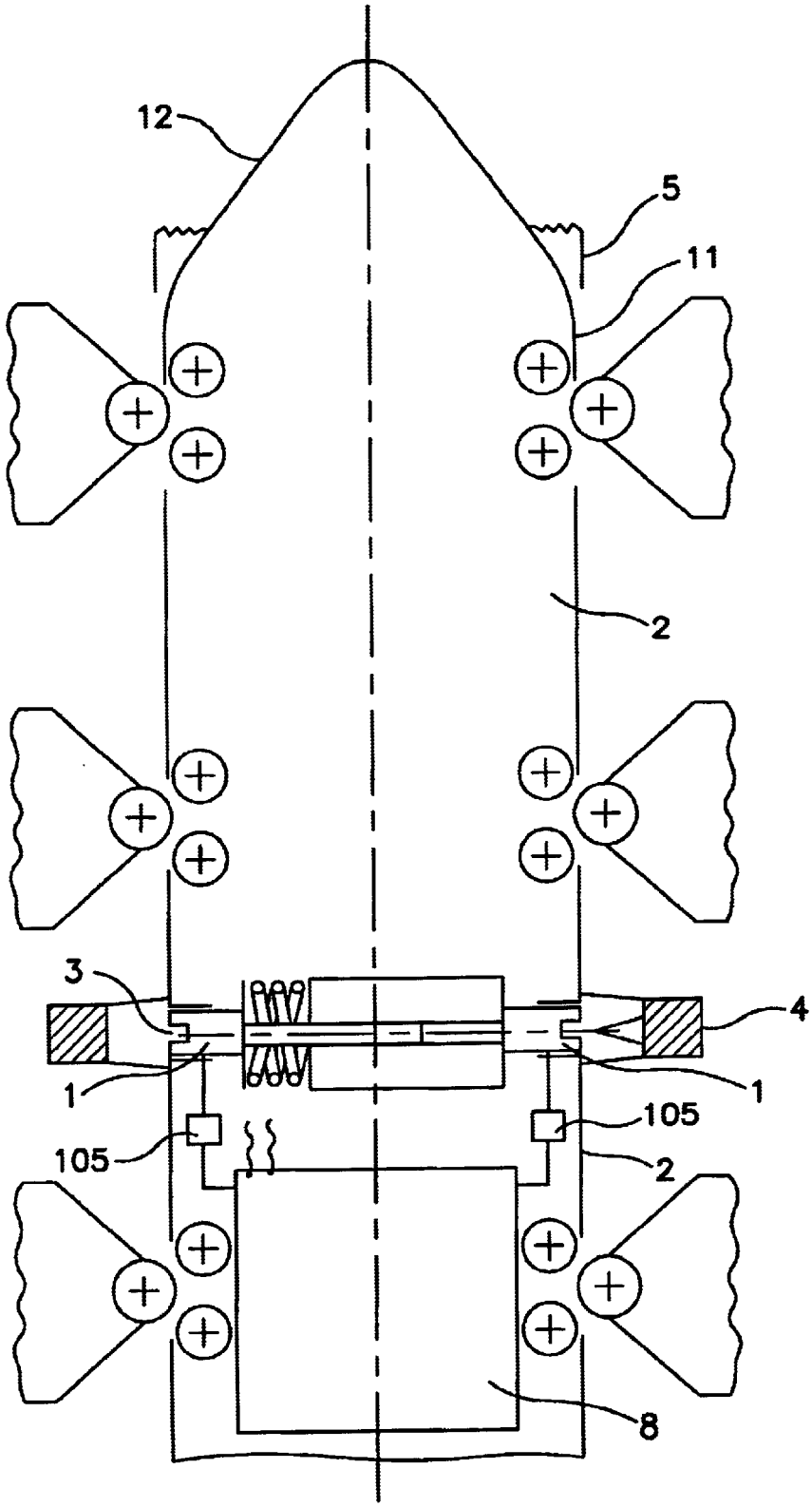
FIG. 1E shows a view of the labeling arrangement according to one possible embodiment including electric control drives.

As well, embodiments can be provided which permit the movement of the pressure bodies 1 by way of electrostatic charge, which can be generated by an apparatus 104 to produce an electrostatic charge (see FIG. 1D). When use is made of this approach, it is of particular advantage in order to attain sufficiently large electrostatic forces, to configure the pressure bodies 1 with particularly large surfaces and to position them adjacent a surface that has an equally large surface. Both surfaces can be supplied with an identical tension that is rather high.

When actuating the pressure bodies 1 from the interior, it is of particular advantage to transmit the control commands that are required for control of the pressure bodies 1 from a location that is exteriorly with respect to the mandrel 2. For this, use can be made of all methods of the prior art, such as, for example, radio signals, magnetic switches, capacitive switches, or mechanical switches.

Figure 1F:
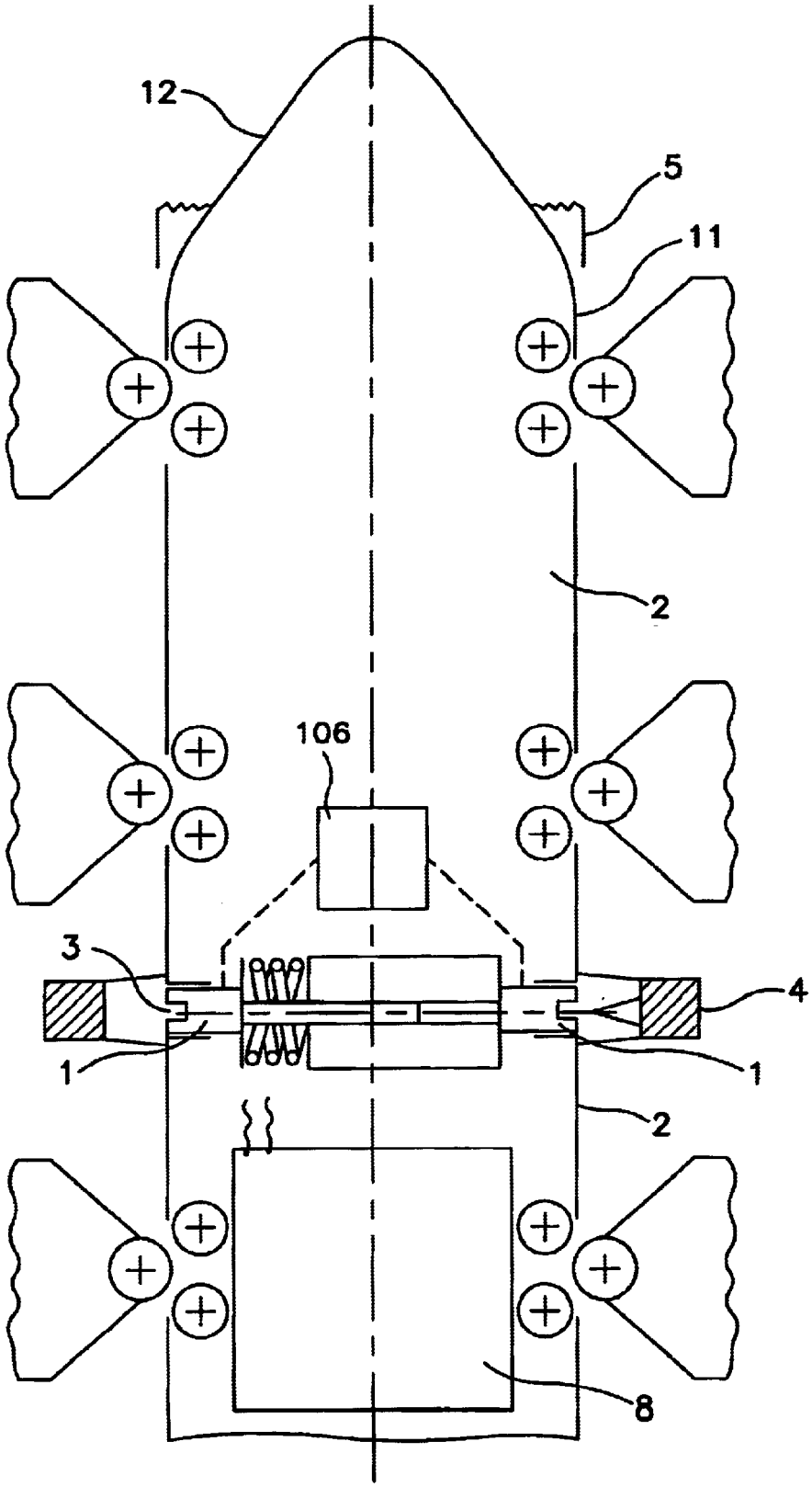
FIG. 1F shows a view of the labeling arrangement according to one possible embodiment including a microcomputer.

For controlling and monitoring of the movements of the pressure bodies 1, a microcomputer 106 (see FIG. 1F) can be disposed within the mandrel 2. Particularly applicable are so-called single-board computers that can perform, with small size, switching functions, metrological functions, and control functions.

Figure 1G:
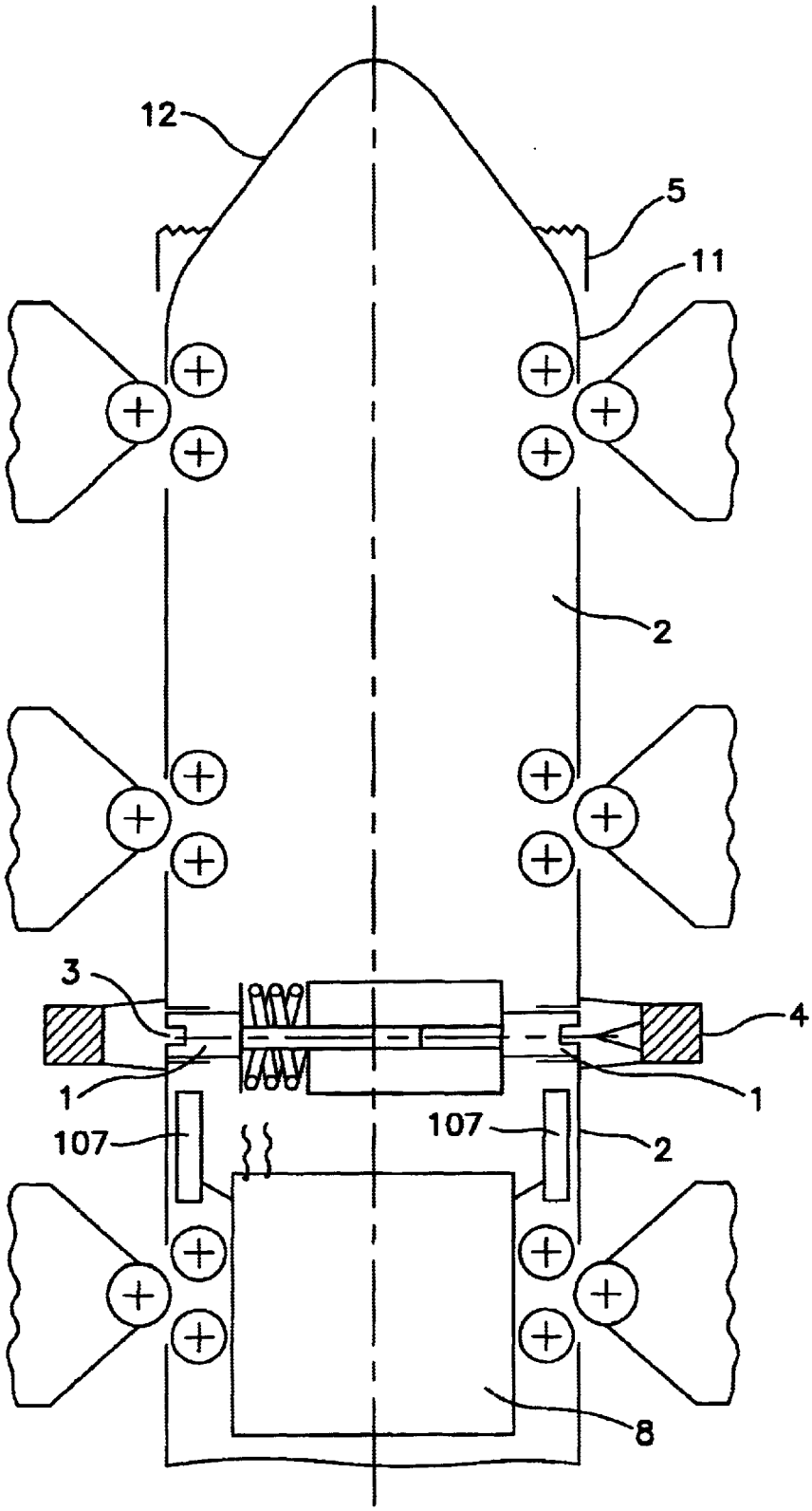
FIG. 1G shows a view of the labeling arrangement according to one possible embodiment including sensors.

As well, within the mandrel 2, sensors 107 (see FIG. 1G) may be disposed that monitor, and/or control, either with or without operative connection to the microcomputer 106, for example, in respect of the supply of tension and the transport velocity of the label tube 5.

Figure 2D:
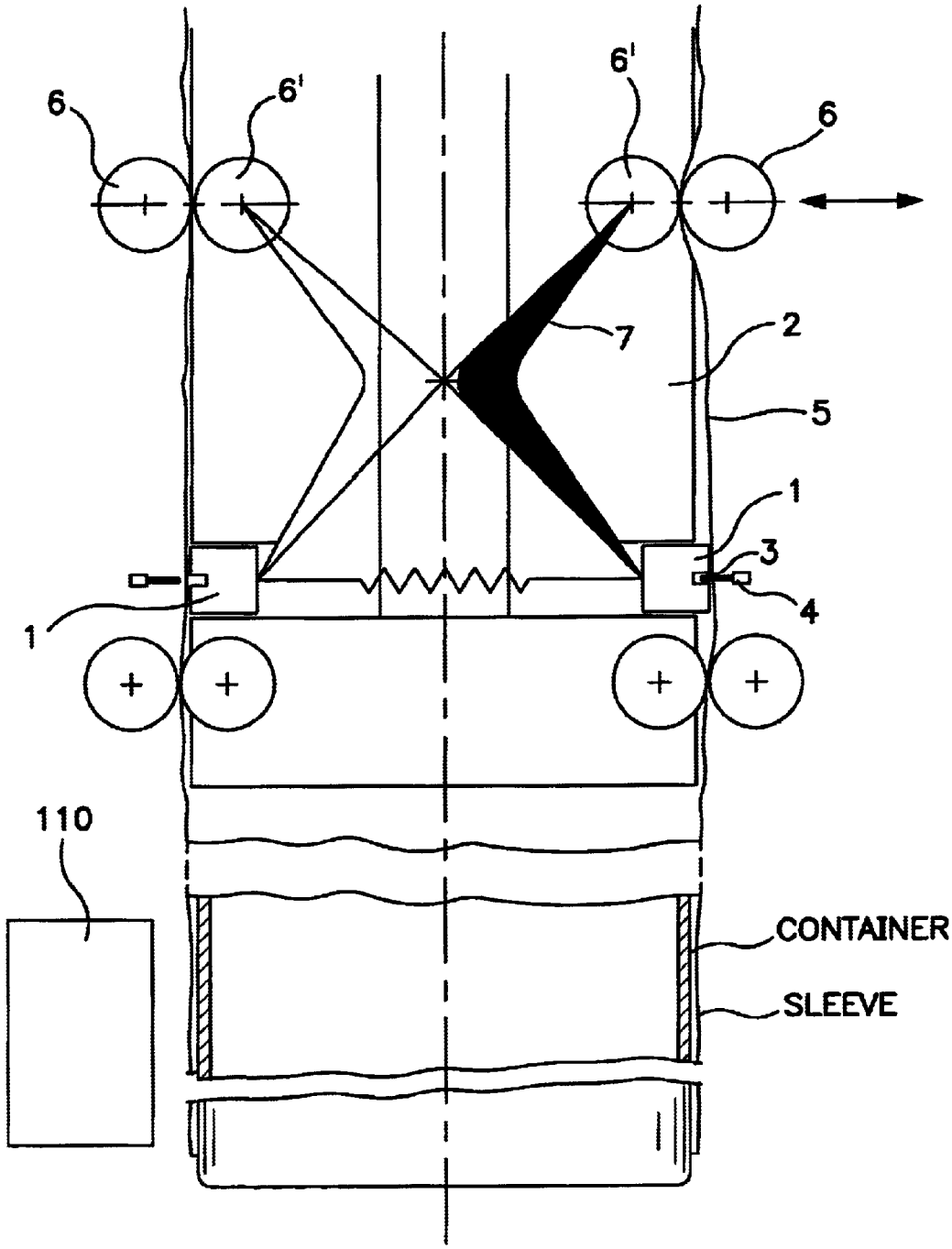
FIG. 2D shows a view of the labeling arrangement according to one possible embodiment including a heating apparatus.

In one other possible embodiment shown in FIG. 2D, a heating apparatus 110 can be located adjacent the location where the sleeve labels are fed onto a container, such as a bottle. The heating apparatus 110 produces heat, for example through heated air, that heats the sleeve labels, which are made of a heat-shrinkable material, to heat shrink the sleeve labels about the container or bottle.

What is claimed is:

1. A labeling station for use in a beverage bottling plant for filling bottles with a liquid beverage filling material, said labeling station comprising:

a storage being configured and disposed to store a continuous collapsed tube of flat uncut sleeve labels disposed sequentially one after the other;

a mandrel structure having a substantially cylindrical outer surface;

said mandrel structure being configured to open a continuous collapsed tube of uncut sleeve labels;

said mandrel structure having a receiving end and a discharge end remote from said receiving end;

a first set of roller apparatus being configured and disposed to advance an opened continuous tube of uncut open sleeve labels along said mandrel structure from said receiving end towards said discharge end;

said first set of roller apparatus being disposed adjacent said receiving end of said mandrel structure;

a second set of roller apparatus being configured and disposed to further advance an opened continuous tube of uncut open sleeve labels received from said first set of roller apparatus along said mandrel structure to said discharge end;

said second set of roller apparatus being disposed between said first set of roller apparatus and said discharge end of said mandrel structure;

a cutting apparatus being configured and disposed to cut an open sleeve label from an opened continuous tube of uncut open sleeve labels to thus produce a cut open sleeve label for a bottle disposed at said discharge end of said mandrel structure;

said cutting apparatus being disposed between said first set of roller apparatus and said second set of roller apparatus;

an expander apparatus being disposed in said mandrel structure; said expander apparatus being configured and disposed to expand and project beyond said outer surface of said mandrel structure to sufficiently expand a portion of an uncut open sleeve label, immediately adjacent said cutting apparatus, between said first set of roller apparatus and said second set of roller apparatus, to make taut a portion of an opened tube of uncut open sleeve labels adjacent said cutting apparatus and thus to minimize bunching of an opened continuous tube of uncut open sleeve labels on said mandrel structure, and also to maximize precision of the cut being effectuated by said cutting apparatus;

said second set of roller apparatus also being configured and disposed to remove a cut open sleeve label from said mandrel structure with sufficient velocity and to position a cut open sleeve label about a bottle disposed at said discharge end of said mandrel structure, and thus to minimize misalignment of the cut of a sleeve label being cut and to permit elevated cutting speeds and thus to afford shorter cycle times; and a heating apparatus being configured and disposed to heat-shrink a cut open sleeve label, positioned by said second set of roller apparatus about a bottle, to the surface of a bottle.

2. The labeling station according to claim 1, wherein:

said expander apparatus comprises a plurality of bodies being configured and disposed to press against an opened tube of uncut open sleeve labels and to make taut the portion of an opened tube of uncut open sleeve labels being cut;

said plurality of pressure bodies each having an exterior shape of a segment of a circle.

3. The labeling station according to claim 2, comprising all of: (a), (b), (c), (d), (e), and (f), wherein (a), (b), (c), (d), (e), and (f) comprise:

(a) a frame structure being configured to hold said mandrel structure, said first and second sets of roller apparatus, said cutting apparatus and said pressure bodies;

(b) a plurality of control rollers being configured and disposed to control expanding of said pressure bodies and to supply an operating force to expand said pressure bodies;

said control rollers being secured to said frame structure adjacent said mandrel structure;

(c) said mandrel structure comprises one of: (i), (ii), (iii), (iv), (v), (vi), (vii), (viii), and (ix), wherein (i), (ii), (iii), (iv), (v), (vi), (vii), (viii), and (ix) comprise:

(i) a lever system disposed within said mandrel structure;

said lever system is operatively connected between said control rollers and said pressure bodies to effectuate transfer of operating force from said control rollers to said pressure bodies to make taut the portion of an opened continuous tube of uncut open sleeve labels being cut;

(ii) a plurality of pneumatic components disposed within said mandrel structure;

said pneumatic components are operatively connected between said control rollers and said pressure bodies to effectuate transfer of operating force from said control rollers to said pressure bodies to make taut the portion of an opened continuous tube of uncut open sleeve labels being cut;

(iii) a plurality of hydraulic components disposed within said mandrel structure;

said hydraulic components are operatively connected between said control rollers and said pressure bodies to effectuate transfer of operating force from said control rollers to said pressure bodies to make taut The portion of an opened continuous tube of uncut open sleeve labels being cut;

(iv) said pressure bodies comprise at least in part a magnetic material;

said frame structure comprises at least one electromagnet being configured to be disposed exteriorly with respect to an opened continuous tube of uncut open sleeve labels and being configured to operate said pressure bodies magnetically to make taut the portion of an opened continuous tube of uncut open sleeve labels being cut;

said at least one electromagnet is secured to said frame structure;

(v) an accumulator configured to store energy to actuate said pressure bodies to make taut the portion of an opened continuous tube of uncut open sleeve labels being cut;

said energy accumulator is disposed within said mandrel structure; and apparatus configured and disposed to transfer electrical energy by way of induction into said energy accumulator within said mandrel structure to operate said plurality of pressure bodies configured to make taut the portion of an opened continuous tube of uncut open sleeve labels being cut;

(vi) a plurality of electromagnets disposed within said mandrel structure;

said electromagnets are configured to actuate said pressure bodies to make taut the portion of an opened continuous tube of uncut open sleeve labels being cut;

(vii) a plurality of electric motors disposed within said mandrel structure;

said electric motors are configured to actuate said pressure bodies to make taut the portion of an opened continuous tube of uncut open sleeve labels being cut;

(viii) apparatus configured and disposed to produce an electrostatic charge;

said electrostatic charge producing apparatus is configured to actuate said pressure bodies to make taut the portion of an opened continuous tube of uncut open sleeve labels being cut; and (ix) a plurality of electric control drives configured and disposed to actuate said plurality of pressure bodies to make taut the portion of an opened continuous tube of uncut open sleeve labels being cut;

(d) a microcomputer disposed within said mandrel structure;

said microcomputer is configured to control actuation of said pressure bodies to make taut the portion of an opened continuous tube of uncut open sleeve labels being cut; and (e) a plurality of sensors disposed within said mandrel structure and configured to monitor an advancing opened continuous tube of uncut open sleeve labels.

4. A container filling plant labeling station configured to label containers, such as, bottles and cans, said labeling station comprising:

a mandrel structure being configured and disposed to open a continuous collapsed tube of uncut sleeve labels disposed sequentially one after the other;

said mandrel structure having a receiving end and a discharge end remote from said receiving end;

apparatus being configured and disposed to advance an opened continuous tube of uncut open sleeve labels along said mandrel structure from said receiving end towards said discharge end;

apparatus being configured and disposed to cut an open sleeve label from an opened continuous tube of uncut open sleeve labels;

an expander apparatus being disposed in said mandrel structure;

said expander apparatus being configured and disposed to expand and project from said mandrel structure to sufficiently expand and make taut a portion of an uncut open sleeve label adjacent said cutting apparatus to minimize bunching of an opened continuous tube of uncut open sleeve labels, and also to maximize precision of the cut being effectuated by said cutting apparatus; and said advancing apparatus also being configured to move a cut open sleeve label from said mandrel structure to position a cut open sleeve label about a container disposed to receive a cut open sleeve label.

5. The container filling plant labeling station according to claim 4, wherein:

said expander apparatus comprises a plurality of bodies being configured and disposed to press against an opened continuous tube of uncut open sleeve labels and to make taut the portion of an opened continuous tube of uncut open sleeve labels being cut;

said plurality of pressure bodies each having an exterior shape of a segment of a circle.

6. The container filling plant labeling station according to claim 5, comprising all of: (a), (b), (c), (d), (e), and (f), wherein (a), (b), (c), (d), (e), and (f) comprise:

(a) a frame structure being configured to hold said mandrel structure, said advancing apparatus, said cutting apparatus, and said pressure bodies;

(b) a plurality of control rollers being configured and disposed to control expanding of said pressure bodies and to supply an operating force to expand said pressure bodies;

said control rollers being secured to said frame structure adjacent said mandrel structure;

(c) said mandrel structure comprises one of: (i), (ii), (iii), (iv), (v), (vi), (vii), (viii), and (ix), wherein (i), (ii), (iii), (iv), (v), (vi), (vii), (viii), and (ix) comprise:

(i) a lever system disposed within said mandrel structure;

said lever system is operatively connected between said control rollers and said pressure bodies to effectuate transfer of operating force from said control rollers to said pressure bodies to make taut the portion of an opened continuous tube of uncut open sleeve labels being cut;

(ii) a plurality of pneumatic components disposed within said mandrel structure;

said pneumatic components are operatively connected between said control rollers and said pressure bodies to effectuate transfer of operating force from said control rollers to said pressure bodies to make taut the portion of an opened continuous tube of uncut open sleeve labels being cut;

(iii) a plurality of hydraulic components disposed within said mandrel structure;

said hydraulic components are operatively connected between said control rollers and said pressure bodies to effectuate transfer of operating force from said control rollers to said pressure bodies to make taut the portion of an opened continuous tube of uncut open sleeve labels being cut;

(iv) said pressure bodies comprise at least in part a magnetic material;

said frame structure comprises at least one electromagnet being configured to be disposed exteriorly with respect to an opened continuous tube of uncut open sleeve labels and being configured to operate said pressure bodies magnetically to make taut the portion of an opened continuous tube of uncut open sleeve labels being cut;

said at least one electromagnet is secured to said frame structure;

(v) an accumulator configured to store energy to actuate said pressure bodies to make taut the portion of an opened continuous tube of uncut open sleeve labels being cut;

said energy accumulator is disposed within said mandrel structure; and apparatus configured and disposed to transfer electrical energy by way of induction into said energy accumulator within said mandrel structure to operate said plurality of pressure bodies configured to make taut the portion of an opened continuous tube of uncut open sleeve labels being cut;

(vi) a plurality of electromagnets disposed within said mandrel structure;

said electromagnets are configured to actuate said pressure bodies to make taut the portion of an opened continuous tube of uncut open sleeve labels being cut;

(vii) a plurality of electric motors disposed within said mandrel structure;

said electric motors are configured to actuate said pressure bodies to make taut the portion of an opened continuous tube of uncut open sleeve labels being cut;

(viii) apparatus configured and disposed to produce an electrostatic charge;

said electrostatic charge producing apparatus is configured to actuate said pressure bodies to make taut the portion of an opened continuous tube of uncut open sleeve labels being cut; and (ix) a plurality of electric control drives configured and disposed to actuate said plurality of pressure bodies to make taut the portion of an opened continuous tube of uncut open sleeve labels being cut;

(d) a microcomputer disposed within said mandrel structure;

said microcomputer is configured to control actuation of said pressure bodies to make taut the portion of an opened continuous tube of uncut open sleeve labels being cut; and (e) a plurality of sensors disposed within said mandrel structure and configured to monitor an advancing opened continuous tube of uncut open sleeve labels.

7. A labeling station configured to label containers, such as, bottles and cans, in a container filling plant, said labeling station comprising:

apparatus being configured to open a continuous collapsed tube of uncut sleeve labels disposed sequentially one after the other;

apparatus being configured and disposed to advance an opened continuous tube of uncut sleeve labels upon opening towards a container disposed to receive a label;

apparatus being configured and disposed to cut an open sleeve label from an opened continuous tube of uncut open sleeve labels; and an expander apparatus in said opening apparatus being configured and disposed to expand and project from said opening apparatus to expand the portion of an uncut open sleeve label being cut.

8. The labeling station configured to label containers according to claim 7, comprising:

apparatus being configured and disposed to advance a cut open sleeve label from said opening apparatus and to position a cut open sleeve label about a container disposed to receive a cut open sleeve label.

9. The labeling station configured to label containers according to claim 8, wherein:

said expanding apparatus comprises a plurality of bodies;

said bodies being configured and disposed to press against an opened continuous tube of uncut open sleeve labels and to make taut the portion of an opened continuous tube of uncut open sleeve labels being cut.

10. The labeling station configured to label containers according to claim 9, wherein:

said plurality of pressure bodies each having an exterior shape of a segment of a circle configured to make taut the portion of an opened continuous tube of uncut open sleeve labels being cut.

11. The labeling station configured to label containers according to claim 10, comprising:

a frame structure being configured to hold said opening apparatus, said advancing apparatus, said cutting apparatus, and said expanding apparatus.

12. The labeling station configured to label containers according to claim 11, comprising:

a plurality of rollers being configured and disposed to control expanding of said pressure bodies;

said control rollers being secured to said frame structure adjacent said opening apparatus.

13. The labeling station configured to label containers according to claim 12, wherein:

said opening apparatus comprises a mandrel structure configured and disposed to open and guide a continuous tube of uncut sleeve labels.

14. The labeling station configured to label containers according to claim 13, wherein:

said mandrel structure comprises one of: (a), (b), (c), (d), (e), (f), (g), (h), and (i), wherein (a), (b), (c), (d), (e), (f), (g), (h), and (i) comprise:

(a) a lever system disposed within said mandrel structure;

said lever system is operatively connected between said control rollers and said pressure bodies to effectuate transfer of operating force from said control rollers to said pressure bodies to make taut the portion of an opened continuous tube of uncut open sleeve labels being cut;

(b) a plurality of pneumatic components disposed within said mandrel structure;

said pneumatic components are operatively connected between said control rollers and said pressure bodies to effectuate transfer of operating force from said control rollers to said pressure bodies to make taut the portion of an opened continuous tube of uncut open sleeve labels being cut;

(c) a plurality of hydraulic components disposed within said mandrel structure;

said hydraulic components are operatively connected between said control rollers and said pressure bodies to effectuate transfer of operating force from said control rollers to said pressure bodies to make taut the portion of an opened continuous tube of uncut open sleeve labels being cut;

(d) said pressure bodies comprise at least in part a magnetic material;

said frame structure comprises at least one electromagnet being configured to be disposed exteriorly with respect to an opened continuous tube of uncut sleeve labels and being configured to operate said pressure bodies magnetically to make taut the portion of an opened continuous tube of uncut open sleeve labels being cut;

said at least one electromagnet is secured to said frame structure;

(e) an accumulator configured to store energy to actuate said plurality of pressure bodies to make taut the portion of an opened continuous tube of uncut open sleeve being cut;

said energy accumulator is disposed within said mandrel structure; and apparatus configured and disposed to transfer electrical energy by way of induction into said energy accumulator within said mandrel structure to operate said plurality of pressure bodies configured to make taut the portion of an opened continuous tube of uncut open sleeve labels being cut;

(f) a plurality of electromagnets disposed within said mandrel structure;

said electromagnets are configured to actuate said pressure bodies to make taut the portion of an opened continuous tube of uncut open sleeve labels being cut;

(g) a plurality of electric motors disposed within said mandrel structure;

said electric motors are configured to actuate said pressure bodies to make taut the portion of an opened continuous tube of uncut open sleeve labels being cut;

(h) apparatus configured and disposed to produce an electrostatic charge;

said electrostatic charge producing apparatus is configured to actuate said pressure bodies to make taut the portion of an opened continuous tube of uncut open sleeve labels being cut; and (i) a plurality of electric control drives configured and disposed to actuate said plurality of pressure bodies to make taut the portion of an opened continuous tube of uncut open sleeve labels being cut.

15. The labeling station configured to label containers according to claim 14, comprising;

a microcomputer disposed within said mandrel structure;

said microcomputer is configured to control actuation of said pressure bodies to make taut the portion of an opened continuous tube of uncut open sleeve labels being cut.

16. The labeling station configured to label containers according to claim 15, comprising:

a plurality of sensors disposed within said mandrel structure and configured to monitor an advancing opened continuous tube of uncut sleeve labels.

17. The labeling station configured to label containers according to claim 16, wherein:

said advancing apparatus comprises apparatus configured and disposed to transfer a cut open sleeve label from said mandrel structure to a predetermined position about a container disposed to receive a cut open sleeve label.

18. The labeling station configured to label containers according to claim 17, wherein:

said opening apparatus comprises fingers configured and disposed to open a continuous collapsed tube of uncut sleeve labels for cutting.

* * * * *

UNITED STATES PATENT AND TRADEMARK OFFICE

CERTIFICATE OF CORRECTION

PATENT NO. : 7,024,841 B2
APPLICATION NO. : 10/653617
DATED : April 11, 2006
INVENTOR(S) : Klaus Krämer and Lutz Deckert It is certified that error appears in the above-identified patent and that said Letters Patent is hereby corrected as shown below:

In column 3, line 14, after 'apparatus', delete " . " and insert -- ; --.

In column 4; line 55, after the first occurrence of 'FIG.', delete "1B," and insert --1B),--.

In column 5, line 64, Claim 1, after 'structure;' begin a new paragraph with "said".

In column 7, line 1, Claim 3, before 'portion', delete "The" and insert --the--.

Signed and Sealed this

Fifteenth Day of August, 2006

JON W. DUDAS
*Director of the United States Patent and Trademark Office*